United States Patent [19]

Hartmann

[11] Patent Number: 4,475,451

[45] Date of Patent: Oct. 9, 1984

[54] MECHANISM FOR RELEASABLY SECURING A DRAINAGE ELEMENT TO A PRESS

[75] Inventor: Eduard Hartmann, Schneisingen, Switzerland

[73] Assignee: Bueher-Guyer AG, Niederweningen, Switzerland

[21] Appl. No.: 405,399

[22] Filed: Aug. 5, 1982

[30] Foreign Application Priority Data

Aug. 17, 1981 [DE] Fed. Rep. of Germany ..... 3132466

[51] Int. Cl.[3] ..... B30B 9/02

[52] U.S. Cl. ..... 100/107; 100/125; 285/401

[58] Field of Search ..... 100/107, 108, 109, 116, 100/125, 126; 285/401, 402, 208, 209, 91, 361, 189

[56] References Cited

U.S. PATENT DOCUMENTS

| | | | |
|---|---|---|---|
| 3,207,064 | 9/1965 | Hauser-Bucher | 100/107 |
| 3,498,642 | 3/1970 | Berger | 285/189 |
| 3,680,285 | 8/1972 | Wellan et al. | 285/361 X |
| 3,951,058 | 4/1976 | Hauser | 100/107 |

*Primary Examiner*—Peter Feldman

*Attorney, Agent, or Firm*—Ernest F. Marmorek

[57] ABSTRACT

In a mechanism for releasably securing a longitudinal and flexible drainage element to a press-plate of a press which has a press-space for squeezing juice from fruits, and wherein the press-plate defines a passage, a securing device which includes a collar is provided which is received in the passage, and at least partially surrounds the drainage element near an end thereof. A securing sleeve is connected to the collar, and is formed with a shoulder, which abuts the press-plate on a side thereof facing the press-space. The drainage element is releasably secured by the securing device to the press-plate. The securing device includes at least one flange formed on the collar, which extends radially outwardly only along a portion of its circumference beyond an annular border of the passage, and is normally rotatable within the passage; the press-plate defines at least one recess which communicates with the passage and matches the flange, so that the securing device may be passed in a first angular position thereof through the passage and the recess, when the flange is aligned with the recess, but when it is rotated thereafter by a predetermined angle to a second angular position, it is restrained from slipping out from the passage in one direction by the flange abutting the press-plate.

15 Claims, 7 Drawing Figures

MECHANISM FOR RELEASABLY SECURING A DRAINAGE ELEMENT TO A PRESS

BACKGROUND OF THE INVENTION

Known securing mechanisms for releasably securing a drainage element to a press are used in universal fruit presses, in which the press contains a press container or receptacle which is rotatable about a horizontal axis, a press plate, and a counter-press plate which are disposed at right angles to a horizontal axis opposite one another. A press-space is defined between the press plate and the counter-press plate, and a plurality of longitudinal flexible drainage elements, each releasably connectable to the press plate and the counter-press plate, extend between the press plates through passages provided in the press plates. For example, in a press having a capacity of approximately 5000 kg of mash, there are provided about 220 of such flexible drainage elements. As a rule each drainage element consists of a void-like flexible core of rubber or similar flexible material, and wherein the core is provided on its circumference with longitudinal grooves extending in an axial direction, and a liquid-permeable sleeve surrounding the core which preferably consists of textile material. The known securing mechanism anchors the core together with the stocking-like sleeve to the press plate, so that the drainage elements are under slight tension in an axial direction, when the press plates are remote from one another, while they are disposed loosely in the mash when the press plates are disposed close to one another as a result of the mash being squeezed by the press plates.

In the known securing mechanism the securing sleeve is provided with a thread in the region of the circumference of a a collar surrounding the sleeve and bordering a radially extending flange, and wherein the threaded sleeve may be threaded into a female thread provided in a passage of the press-plate up to a region where the radially extended flange is located. The inner circumference of the securing sleeve or collar has a shape of a truncated female cone within a region where the securing sleeve or collar extends through the passage in the press plate to a fluid-receiving chamber from the radially extending flange up to the free end of the collar facing the fluid-receiving chamber. A similarly formed matching cone consisting of two portions is provided near the free end of each drainage element, in such a way that below the liquid-permeable sleeve a rubber sleeve surrounds the flexible core as a first portion, and that there is provided a rigid supporting truncated cone which abuts the rubber sleeve, and which is secured to the core as a second portion. By the engagement of the truncated cone disposed on the inner periphery of the securing sleeve with the truncated cone secured to the drainage element, the drainage element is anchored to the press plate by means of the securing sleeve being threaded to the press plate through the passage in the press plate, so that the liquid-permeable sleeve is clamped between the two truncated cones.

Although this known securing mechanism fulfills the function assigned thereto, namely to discharge the fluid obtained from the press along the grooved channels of the drainage element through the passage in the press-plate to the fluid-receiving channel in a satisfactory manner, it nevertheless has disadvantages concerning the method of securing the drainage element to the press-plate and releasing it therefrom. These disadvantages are due to the fact that, on one hand, it is very time-consuming to thread the 220 to 440 securing mechanisms to to the press plate, and, on the other hand, due to too much force being required for this task. Additionally during securing of the drainage-element to press-plates there occurs the risk that during threading of the securing sleeve any tool used therefor, for example, a fork wrench, or spanner engaging the flange of the securing sleeve from the side of the press-space, that fork wrench or spinner may slide off therefrom, which can result in damage to the liquid-permeable sleeve of the drainage element.

Furthermore, the relatively small distance between the individual securing mechanisms requires the use of a special tool. This does not, however, preclude the tool engaging the securing-sleeve from jamming, which further impairs the installation of the drainage elements.

Finally, after the drainage element is threaded into the corresponding female thread of the press-plate it is a considerable disadvantage that the increasing friction between the two matching male and female cones may lead to a twisting of the sleeve clamped therebetween with respect to the inner core. In order to avoid such a twist, the sleeve must be rotated several turns prior to threading of the securing sleeve into the press plate, so that one obtains at most only a negligible twist of the sleeve itself. These special precautions prolong the installation, without ensuring that the sleeve may not be damaged by the two cones.

SUMMARY OF THE INVENTION

It is therefore one of the principal objects of the invention to devise a securing mechanism of the afore-described kind while avoiding the afore-noted disadvantages, and to so construct the securing device that most of the time required for installing the drainage element and for releasing it from the press is minimized, as well as to reduce any wear and tear of the drainage elements themselves.

This object is attained, according to the invention, by the collar being received in the passage of the press-plate being rotatable therein, and being formed with at least one flange which extends radially outwardly only along a portion of its circumference beyond an angular border of the passage, and wherein the press-plate defines at least one recess communicating with a passage and matching the flange, so that the securing means may be passed in a first angular position thereof through the passage and the recess, when the flange is aligned with the recess, but the securing means, when rotated thereafter at a predetermined angle to a second angular position is restrained from slipping out from the passage in one direction by the flange abutting the press plate.

As in the inventive solution the securing sleeve may only pass in the unlocked position thereof through the passage in the press-plate, and need only be rotated by a small angle, for example of the order of 90 degrees, so as to be secured in the locked angular position thereof, by causing an engagement between a radially extending flange and the surface of the press-plate facing the fluid-receiving chamber, the drainage elements can be rapidly and easily secured to the press plate. Furthermore, where the drainage element consists of a core and a sleeve, a significant relative rotation between the core and the sleeve is avoided. This leads to the further advantage that wear and tear or damage of the drainage element during installation is avoided. Furthermore, the manufacturing cost, compared to the state-of-the-art where the drainage element is provided with a thread, is small, as the passages in the press-plate can be stamped, which results in turn in a shorter manufacturing time, compared to that needed to cut the thread. Finally the inventive solution is fully compatible with known securing mechanisms, so that key parts thereof are still usable.

In a preferred embodiment of the invention there is provided an additional flange similar to the one flange, which is disposed diametrically opposite the one flange on the collar, and wherein the press plate defines an additional recess similar to the one recess, which is located diametrically opposite the first recess. This ensures a uniform distribution of the axial forces appearing between the projections on flanges facing the fluid-receiving chamber, and the surface of the press-plate facing the fluid-receiving chamber, which axial forces act along the periphery of the securing sleeve, which again avoids any tipping or jamming of the securing mechanism in the press-plate itself. This advantage is already obtained by a single pair of flanges in such securing mechanism, so that a possible arrangement of a plurality of such pairs, as far as a uniform distribution of forces is concerned is not absolutely necessary.

As far as a special shape is concerned, it is particularly advantageous if the flange and the recess, as viewed at right angles to the axial direction, each have the shape of a segment of a circle. This shape can be manufactured very easily.

Where only a single pair of flanges are provided, it is advantageous if the flange has the shape of a segment extending over an angle of about 90 degrees of a circle. By using such dimensions, the region which is at most available between the flanges and the press-plate, namely one half of the periphery of the passage in the press plate, is fully made use of, so that this alternate abutting of the flanges is particularly effective.

A further advantageous embodiment, which has particular advantages for the manufacture of the securing device, is obtained if the peripheral region of the collar extending between the flanges in a direction facing away from the press-plate is made flat. Where exactly two flanges are provided, such flanges, when viewed in a direction at right angles to the longitudinal axis, will be seen to make contact with similarly flat regions in the plate or element surrounding the securing mechanism.

In a particularly important further development of the invention, the securing device includes locking means releasably locking the securing means against rotation relative to the press-plate in the second angular position. This ensures, on one hand, that during installation a locked second angular position is defined precisely, and on the other hand, any unintended loosening of the securing device during operation is prevented.

In this respect an advantageous implementation results where the locking means defines an axially directed bore in the press-plate, a second axially directed bore in the flange, wherein both bores are aligned in the second angular position with each other, and if there is further provided a pin received in the second bore and projecting outwardly from the second bore, and resilient means disposed at least partially in the second bore urging the pin to engage the first bore when the securing mechanism is in the second angular position. Here, during transition from the locked to the unlocked position, the pin is disengaged from the second bore, into which it had projected during a locked position, and is pressed inwardly, so that it no longer projects beyond the flange, and the free rotation of the securing sleeve with respect to the press plate is restored.

A further alternative advantageous implementation is obtained when the locking means defines a bore in the press-plate, and if it further includes a resilient plate including a pin projecting from the resilient plate in a direction away from the press-space, and capable of being aligned with the bore in the second angular position of the securing device; the resilient plate is secured to the flange within a small peripheral region thereof, and so positioned that when the bore and the pin are aligned, the pin is urged by the resilient plate to engage the bore. The flange has a maximum diameter, and the resilient plate is preferably ring-shaped and has a diameter only slightly exceeding the maximum diameter of the flange, and wherein the pin and the small peripheral region are located diametrically opposite one another. In this implementation the required resilience for the pin, on the one hand passing into the bore, and on the other hand being disengaged therefrom, is obtained in a particularly simple manner by therein the ring-shaped plate being secured to the flange only within a small peripheral region, such as being point-webbed thereto, so that its elasticity permits the fing-shaped plate to yield. A particularly advantageous implementation is obtained when the pin and the small peripheral region are located diametrically opposite one another.

A further advantageous implementation which increases the resilience of the ring-shaped plate in an axial direction is obtained when the ring-shaped plate is provided with a radial slit. It is particularly advantageous when the pin projects outwardly from the resilient plate near the slit, and if the ring-shaped plate has substantially the shape of a single-turn helix. This permits adjustment of the ring-shaped plate in an axial direction by engaging the slit, for example, by means of a screwdriver or by a finger. An additional implementation facilitating axial movement of the ring is obtained when the resilient plate defines a shaped recess near its periphery on a side thereof facing the press-plate within the region of the pin to facilitate distancing a portion of the resilient plate from the press-plate. Here again contact can be obtained with the shaped recess by means of a finger or screwdriver, so that the ring-shaped plate can be moved axially. In a further development the flange defines on a side thereof facing the press-plate an annular groove, and a sealing ring is disposed in the groove which abuts the press-plate. This ensures complete sealing between the fluid-receiving chamber and the press space, which, due to the small gap existing between the securing sleeve and the passage in the press plate could possibly not be obtained by any other means. The construction is further simplified if the securing device includes a resilient ring-shaped plate forming a radial outer border for the annular groove.

BRIEF DESCRIPTION OF THE DRAWINGS

For a full understanding of the nature and objects of the invention, reference should be made to the following detailed description, taken in connection with accompanying drawings in which.

DESCRIPTION OF THE PREFERRED EMBODIMENTS

Figure 1:
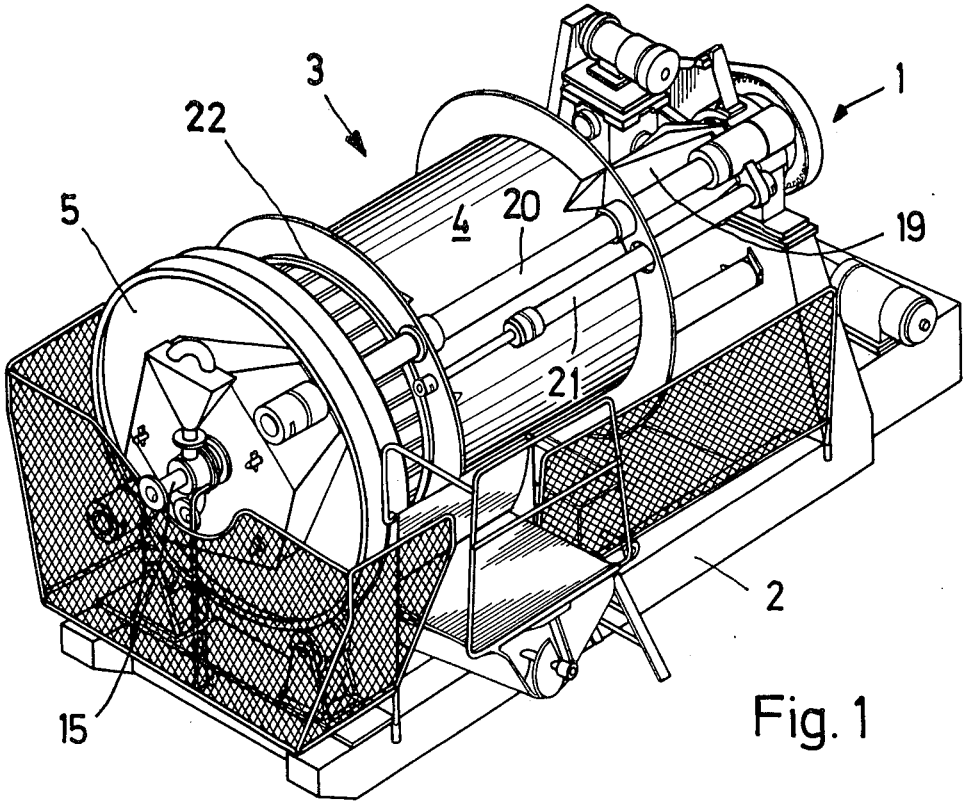
FIG. 1 is a perspective view of a press provided with a plurality of flexible drainage elements, according to the present invention.
Figure 2:
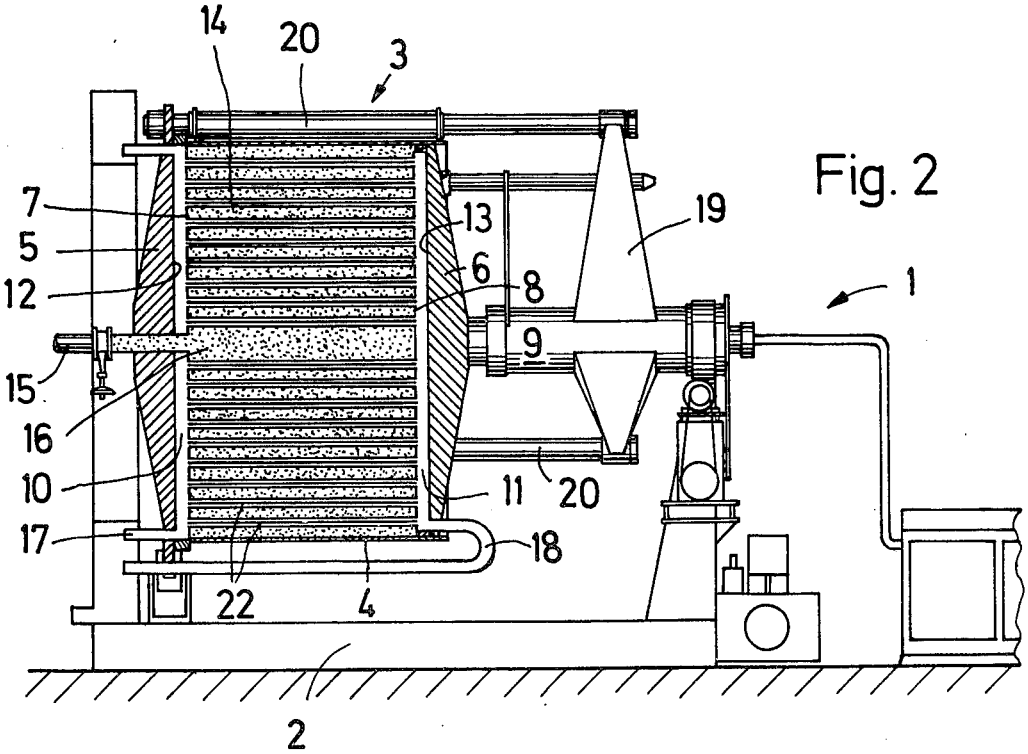
FIG. 2 is a longitudinal section of the press shown in FIG. 1.

In carrying the invention into effect, and referring in particular to FIGS. 1 and 2, there will be seen a driven cylindrical press container 3 rotatably disposed about a horizontal axis, consisting of a press receptacle 3 forming a cylindrical mantle, and press covers 5 and 6 disposed on each side of the press receptacle 3. Between the press covers 5 and 6 and within the press receptacle 3 there are disposed two radially extending press-plates 7 and 8 near, but at a certain distance from respective covers 5 and 6. The press-plate 7 near the press cover 5 is the stationary press-plate, while the press-plate 8, near the press-cover 6 is axially drivable by means of the hydraulic cylinder 9. Fluid-receiving chambers 10 and 11 are defined, on one hand, between the stationary press-plate 7 and the face 12 of the press-cover 5, and on the other hand between the face 13 of the press-cover 6 and the axially slidable press-plate 8.

Between the press-plates 7 and 8 there is defined a press-space 14; a supply conduit 15 passes through the press-space 14, as well as centrally through the press cover 5 and the press-plate 7 carrying mash, while the fluid squeezed from the mash during pressing of the goods can filter through the fluid-receiving chambers 10 and 11, and be discharged therefrom by discharge conduits 17 and 18. So as to remove the mash from the press-plate 14, the press container 4 is guided by two guide rods 20 which connect the press cover 5 to a drive rotor 19, the axial displacement of the press container 4 being effected by two diametrically oppositely disposed hydraulic cylinders 21. In FIG. 1 there is shown the state where the press container 4 is opened in order to expel the spent mash 16.

In the press-space or chamber bore 14 are disposed between the two press plates 7 and 8 a plurality of longitudinal and flexible drainage elements 22, which extend parallel to one another and pass axially through the press plate 14 in the position or mode of the press, where the two press-plates 7 and 8 are most remote from one another. In a press having a capability for a mash of about 5,000 kg, approximately 220 of such drainage elements 22 are provided. The drainage elements 22 are secured to the press-plates 7 and 8 near a respective end thereof, and serve to discharge the fluid obtained from the mash during pressing operations to the fluid-receiving chambers 10 and 11.

Figure 3:
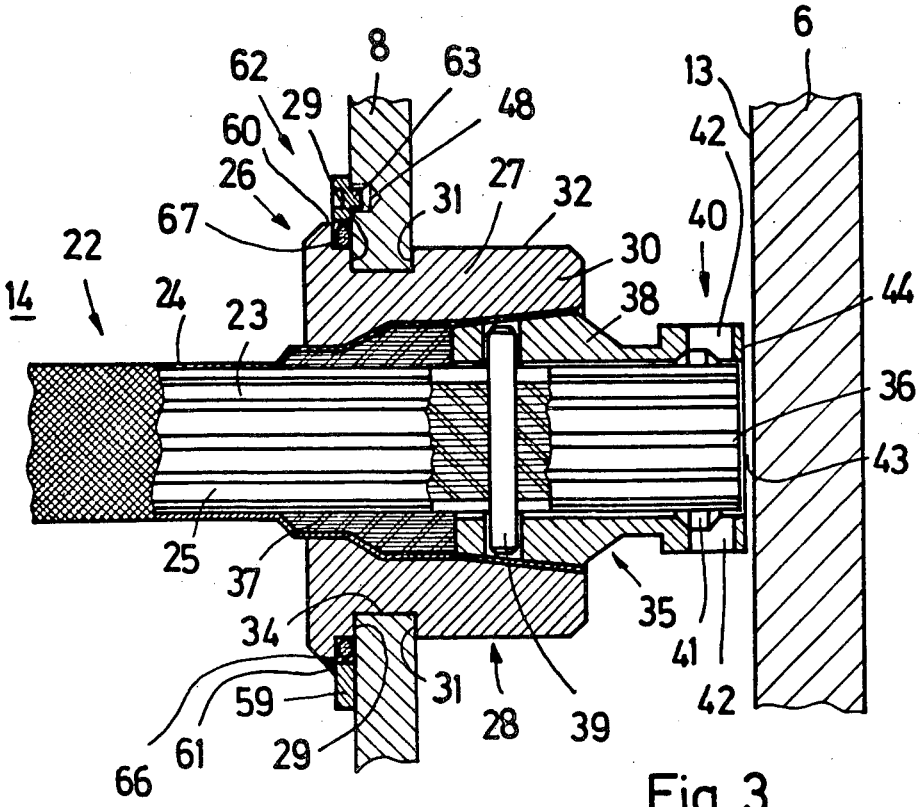
FIG. 3 is a longitudinal section through a securing device, according to the present invention, for a drainage element.

As seen in FIG. 3, each drainage element 22 includes a flexible core 23, consisting of rubber or similar flexible material in the form of a flexible rod or bar, as well as a liquid-permeable sleeve 24 surrounding the core 23, which is preferably made of textile material and surrounds the core 23 in a stocking-like manner. The core 23 is furthermore provided on its surface with axially extending grooves or channels 25, along which the liquid obtained during pressing operations passing through the sleeve 24 is then discharged therefrom.

As can be particularly seen from FIGS. 3 through 6, the drainage element 22 is provided near its end with securing means 26, seen particularly clearly in FIG. 3, and is secured or anchored to the press plate 7 or 8 through a passage 27 in each press plate. The securing mechanism 26 includes a collar 30, from which there extends in a radial direction a flange 29, which in turn abuts a corresponding press plate 7 or 8. The collar 30 passes through the passage 27 and extends into the fluid-receiving chamber 10 or 11.

A recess in the collar 30 defines two edges or flanges 29 and 31, the width of the recess only slightly exceeding that of the press plate 7 or 8. This recess extends, however, as seen in an end view, over only a part of the circumference 32 of the collar 30. As can be seen particularly in connection with FIG. 5, the passage 27 is bordered by the circumferential border 34 and communicates with recesses 33; the securing device 26 may pass through the passage 27 and the recesses 33 in an unlocked angular position thereof.

The securing device 26, and in particular the collar 30 thereof is formed with a conically-shaped opening or passage 35 diverging toward the fluid-receiving chamber 10 or 11. Within the passage 35 there extends below the liquid-permeable sleeve 24 a cone-shaped sleeve 37 along one end of the drainage element 22, which surrounds the flexible core 23 near its free end 36. The cone-shaped sleeve 37 is preferably made of a flexible material, like rubber, and on the side of the fluid-receiving chamber 10 or 11 there abuts on the cone-shaped sleeve 37 a cone-shaped ring 38, which extends at least up to the free end 36 of the core 23. The core 23 and the liquid-permeable sleeve 24 are spaced from one another by the cone-shaped sleeve 37 within the securing mechanism 26, so that the grooves or channels 25 can freely pass juice extracted from the mash, and furthermore so as to ensure the flexibility of the drainage elements 22 within a discharge region of the securing device 26. The conically-shaped ring 38, which is made of rigid material, such as metal, is connected to the flexible core 23 within the conically-shaped opening 37 by a pin 39 radially passing through the core 23. An end region 40 near the free end 36 of the core 23 of the conically-shaped ring 38 is provided on an inner circumference thereof facing the core 23 with an annular groove 41, which communicates with discharge openings 42 radially extending through the conically-shaped ring 38, so as to facilitate passage of the juice to the fluid-receiving chambers 10 and 11.

The installation of each drainage element 22 is accomplished by sliding the securing device 26 toward the free end 36 of the core 23 over the liquid-permeable sleeve 24, and thereafter the cone-shaped sleeve 37, and the conically-shaped ring 38 is slid into the passage 27 over the core 23. Thereafter the securing mechanism 26 is passed from the press-space 14 in its unlocked position through the passage 27 and is subsequently rotated by an angle less than 360 degrees, for example 90 degrees, so that a locked angular position thereof is obtained, where the flange 31 radially extending outwardly abuts the press plate 7 or 8 within the region of the fluid-receiving chamber 10 or 11. Thus during the pressing operation the securing device 26 abuts with the flange or edge 31 of the core 30 the press plate 7 or 8, while the front end 44 of the conically-shaped ring 38 normally spaced at a small gap 43 from the inner side 12 and 13 of the press covers 5 and 6 abuts during the pressing operation the press cover 5 and 6, respectively, as a result of a small bending of the press plates 7 and 8. Thus each drainage element 22 is firmly anchored to the press plate 7 and 8, by the core 23 being maintained within the securing device 26 by the conically-shaped ring 38, and by the liquid-permeable sleeve 24 being jammed within the passage 27 between the collar 30, on one hand, and the cone-shaped sleeve 37 and the conically-shaped ring 38, on the other hand.

Figure 5:
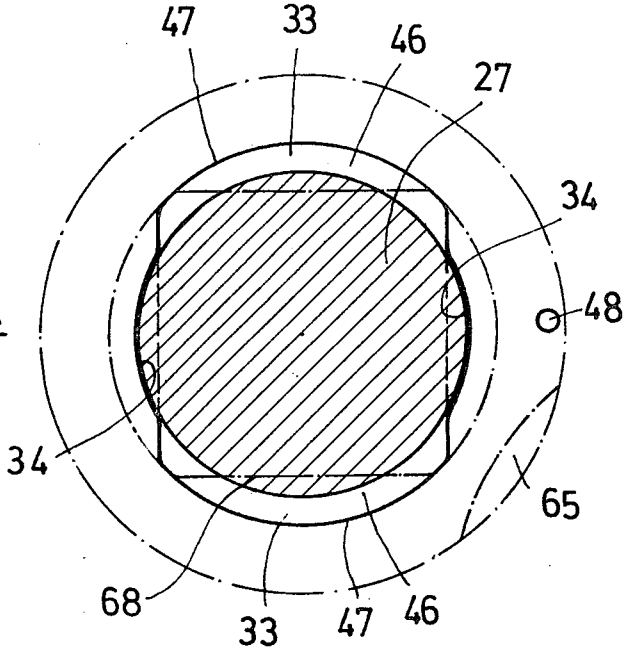
FIG. 5 is an end view of the securing device in part section along the line V—V of FIG. 4, when passing through a passage in the press-plate.
Figure 4:
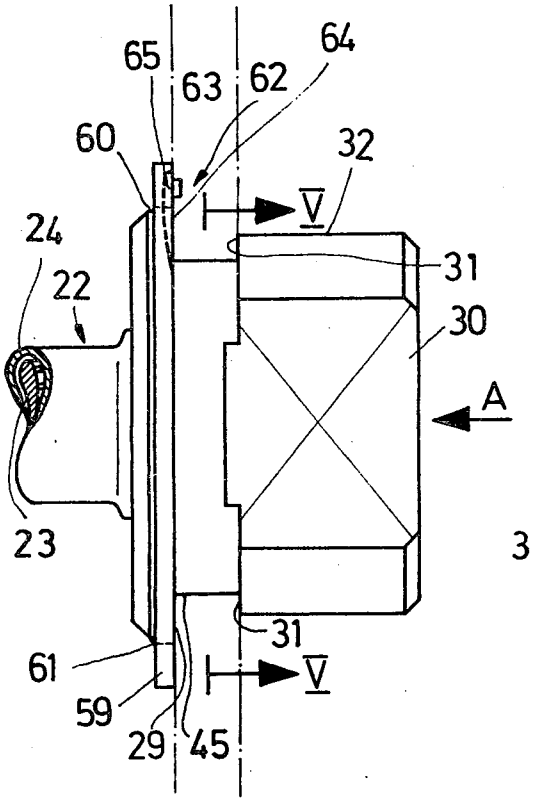
FIG. 4 is a side elevational view of the securing device.
Figure 7:
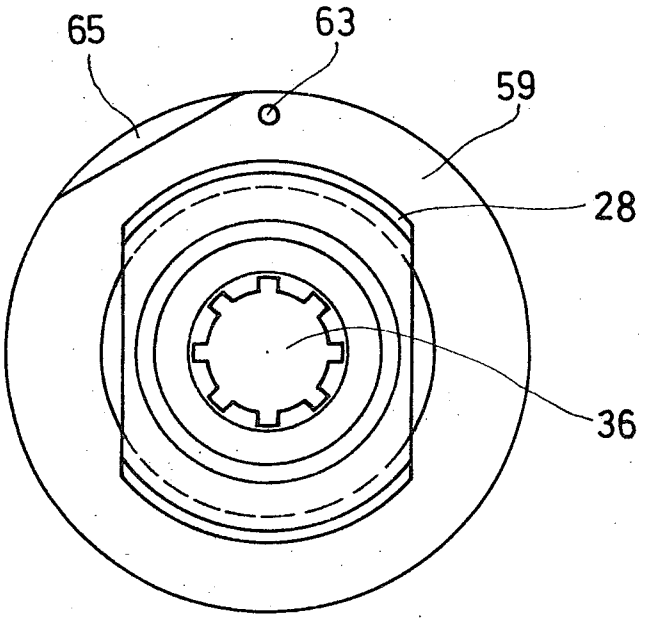
FIG. 7 is an end view of the collar of the securing device as seen along the arrow A of FIG. 4.

As seen in the implementation illustrated in FIGS. 4, 5 and 7, two edges or flanges 31, and corresponding recesses 33 are exactly disposed directly opposite one another. The edges or flanges 31, according to FIG. 4, when viewed in end view, have each the form of a circular segment which extends over an angle of 90 degrees. The shape of the flange 31 is obtained, in the implementation illustrated, by the collar 30 having a cylindrical guide surface 45 along a part of its circumference exceeding the actual thickness of each press plate 7 and 8 only slightly, which guide surface 45 extends between the flange 29 and the flange 31, but is flattened in another circumferential region thereof between the flanges 29 and 31 by suitable milling. The aforenoted recess bordered by the flanges 29 and 31 extends generally within a region of the fluid-pressure receiving chambers 10 and 11. The recesses 33 matching in shape those of the flanges 31, can be seen particularly clearly in FIG. 5.

The passage 27 defines in a region 46, shown dash-dotted and extending over an angle of 90 degrees, oppositely disposed recesses 33, the outer border of the recesses 33 being defined by a circle 47.

Thus, as seen in FIG. 5, the flanges 33 extend upwardly and downwardly matching in shape those of the recesses 33, the securing mechanism passing freely through the passage 27 in the unlocked position. When the securing mechanism is rotated by 90 degrees, from the unlocked position, however, the flanges 31 abut a respective press plate 7 and 8, thus restraining the securing mechanism from passage through the opening 27 in a direction toward the press-plate 14.

Figure 6:
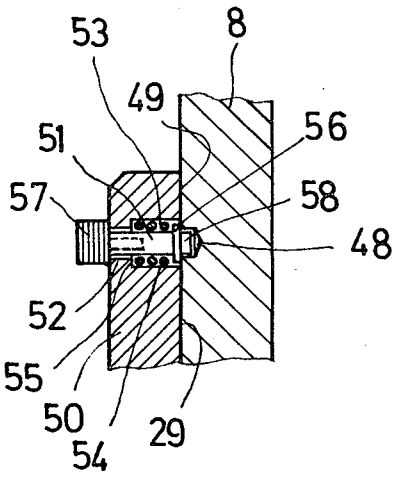
FIG. 6 is a fragmentary sectional view of a portion of the securing device illustrating locking means preventing an angular rotation of the securing device.

In order to secure the securing device 26 against any unintentional or inadvertent rotation in its locked position, there are provided locking means, which in the locked angular position engage the recess or bore 48 provided on a side of each press plate 7 or 8 facing the press space 14. The locking means are implemented, as shown in the implementation of FIG. 6, by a short pin 51, which extends within a recess 52 of the securing sleeve 50 radially outwardly from the collar 32. A bore 53, having a diameter larger than that of the recess or bore 52, communicates with the bore 52, and receives the compression spring 54, which abuts on one side thereof the shoulder 55 of the bore 53, and abuts with the other side thereof a collar 56 of the pin 51. The pin 58 is provided at an end thereof facing away from a respective press plate 7 or 8 with a thread terminating in a head 57, which may be threaded into a corresponding female thread formed in the bore 52, which feature limits the actual projection of the free end 58 of the pin 51 into the bore 48 provided in each press-plate 7 or 8.

An alternate implementation to prevent any unintentional rotation of the securing device 26 is shown in FIGS. 3 and 4, where a ring 59 is provided peripherally surrounding the circumference 60 of the flange 29. The ring 59 has an inner diameter slightly larger than the outer diameter of the flange 29, so that it can be displaced axially along the flange 29. But the ring 59 is secured within a small peripheral region 61 only to the outer circumference 60 of the flange 29, for example by means of a small welded spot region. While the ring 59, in view of its resilience, can be axially displaced from the flange 59 at a distance from the peripheral region 61, its maximal axial displacement is obtained when the region 62 is located diametrically opposite the connecting region 61. Within this region 62 there is secured to the ring 59 an axially projecting bolt or pin 63, which, similarly to the pin 51 shown in FIG. 6 extends into a bore or recess 48 of the respective press plate 7 and 8.

The resilience of the ring 59 required to insert the pin 63 into the bore 48, or to remove it therefrom is further improved by providing the ring 59 with a radial slit, so that an open ring is obtained. In this case the ring preferably takes the form of a single-turn helix. In this implementation the connecting region 61 advantageously formed in the form of a welding spot is located near a region close to the slit, and the pin 63 is then disposed on a region of the ring 59 approximately opposite to that of the slit.

This disengagement of the pin 63 from the bore 58 can be accomplished manually by the aforesaid implementation of the slotted ring 59 in the form of a single-turn helix. This implementation makes it possible to engage the ring through the slit, for example either by a finger or with the aid of a screwdriver, and to exert a slight force directed axially, whereby the pin 63 can be removed from the bore 58 due to the elasticity of the ring 59.

A further alternate implementation to facilitate axial distancing of the ring 59 from the flange 29 is shown in FIGS. 4 and 5, by providing the ring 59 in the region of the pin 63 on a surface 64 thereof facing a respective press plate 7 or 8 with a shaped recess 65, which may easily accommodate a finger, or which can be actuated by a screwdriver for distancing of the ring 59 from the flange 29.

As has already been stated, there exists between the press-plates 7 and 8, and the securing mechanism 26 guided within the passage 27 a small play, both in a radial, as well as in an axial direction, so as to permit free rotation of the securing mechanism 26 between its locked and unlocked position. However, in order to insure that the press-plate 14 is reliably sealed with respect to the fluid-receiving chambers 10 and 11, there is provided, as shown in FIG. 3 on a side of the flange 29 facing the press-plate 14, an angular recess 66 for receiving a sealing ring 67. While in the implementation shown in FIG. 6 the angular recess 66 is formed by a groove shown in the flange 50, in the implementation shown in FIG. 3 the angular recess 66 is bordered radially outwardly by the ring 59, whose axial thickness determines the axial depth or width of the angular recess 66. When the securing device 26 is rotated between the locked and unlocked positions, the sealing ring 67 extending axially slightly beyond the angular recess 66 yields slightly when an axial pressure is exerted thereonto, which is made possible in view of the small gap 43 existing in the non-tensioned state of the press-plates 7 and 8 between the respective press-plate and the free end 44 of the securing mechanism 26, so that while the securing mechanism 26 may be freely rotated, the press-space 14 is also reliably sealed from the fluid-receiving chamber 10 or 11.

I wish it to be understood that I do not desire to be limited to the exact details of construction shown and described, for obvious modifications will occur to a person skilled in the art.

Having thus described the invention what I claim as new and desire to be secured by Letters Patent is as follows:

1. In a mechanism for releasably and sealably securing a plurality of longitudinal and flexible drainage elements in a fluid-tight manner to a press-plate of a press-space for squeezing juice from fruits or the like, wherein the press-plate defines a passage, and comprising securing means associated with each drainage element, said securing means including a collar received in said passage and at least partially surrounding a corresponding drainage element near an end thereof, and a securing sleeve connected to said collar and formed with a shoulder abutting the press-plate on a side thereof facing said press-space, said corresponding drainage element being releasably secured by means of said securing means to said press-plate in combination said securing means comprising at least two flanges formed on said collar so as to be spaced from one another and extending radially outwardly only along a portion of the circumference of said collar beyond an annular border of said passage, and wherein said securing means is normally rotatable within said passage, and said press-plate defines at least two recesses communicating with said passage and matching said flanges, respectively, whereby said securing means may be passed in a first angular position thereof through said passage and said recesses when said flanges are aligned with said recesses, respectively, but said securing means, upon being rotated thereafter by a predetermined angle to a second angular position is restrained from slipping out from said passage in one direction by said flanges abutting said press-plate.

2. The mechanism as claimed in claim 1, wherein said flanges are similar, and wherein one flange is formed diametrically opposite the other flange on said collar, and wherein one recess is similar to the other recess, and is located diametrically opposite said one recess.

3. The mechanism as claimed in claim 1 wherein each flange and each recess, as viewed at right angles to said direction, has the shape of a segment of a circle.

4. The mechanism as claimed in claim 3, wherein said segment extends over an angle of about 90° of said circle.

5. The mechanism as claimed in claim 2 wherein the peripheral region of said collar extending between said flanges in a direction facing away from said press-space is flat.

6. The mechanism as claimed in claim 1 wherein said securing means includes locking means releasably locking said securing means against rotation relative to said press-plate in said second angular position.

7. The mechanism as claimed in claim 6, wherein said locking means defines an axially directed first bore in said press-plate, a second axially directed bore in at least one of said flanges, said bores being aligned in said second angular position with each other, and further including a pin received in said second bore and projecting outwardly from said second bore, and resilient means disposed at least partially in said second bore urging said pin to engage said first bore when said securing means is in said second angular position.

8. The mechanism as claimed in claim 6, wherein said locking means defines a bore in said press-plate, and further comprising a resilient plate including a pin projecting from said resilient plate in a direction away from said press-space, and capable of being aligned with said bore in said second angular position of said securing means, said resilient plate being secured to at least one of said flanges within a small peripheral region thereof and so positioned that upon said bore and said pin being aligned, said pin is urged by said resilient plate to engage said bore.

9. The mechanism as claimed in claim 8, wherein said at least one flange has a maximum diameter, and said resilient plate is ring-shaped and has a diameter only slightly exceeding the maximum diameter of said one flange, and wherein said pin and said small peripheral region are located diametrically opposite one another.

10. The mechanism as claimed in claim 9, wherein said ring-shaped plate has a radial slit to increase its resiliency.

11. The mechanism as claimed in claim 10, wherein said pin projects outwardly from said resilient plate near said slit.

12. The mechanism as claimed in claim 10, wherein said ring-shaped plate has substantially the shape of a single-turn helix.

13. The mechanism as claimed in claim 8, wherein said resilient plate defines a shaped recess near its periphery on a side thereof facing said press-plate within the region of said pin to facilitate distancing a portion of said resilient plate from said press-plate.

14. The mechanism as claimed in claim 1 wherein at least one of said flanges defines on a side thereof facing said press-plate an annular groove, and further comprising a sealing ring disposed in said groove and abutting said press-plate.

15. The mechanism as claimed in claim 14, wherein said securing means includes a resilient ring-shaped plate forming a radially outer border for said annular groove.

* * * * *